United States Patent [19]

Lang

[11] 3,999,714

[45] Dec. 28, 1976

[54] SHOWER HEAD WATER FLOW REDUCING DEVICE

[76] Inventor: Keith M. Lang, 5038 Dominick Spur, Hopkins, Minn. 55343

[22] Filed: Oct. 30, 1975

[21] Appl. No.: 627,287

[52] U.S. Cl. ..... 239/570; 239/590.3; 138/44

[51] Int. Cl.[2] ..... B05B 1/30; B05B 1/18

[58] Field of Search ..... 239/590.3, 542, 543, 239/31, 24, 460, 570, 456; 138/44

[56] References Cited

UNITED STATES PATENTS

| | | | |
|---|---|---|---|
| 1,020,405 | 3/1912 | Engel | 239/31 |
| 2,409,294 | 10/1946 | Martin | 138/44 |
| 2,585,845 | 2/1952 | Rosenblum | 239/31 |
| 2,712,458 | 7/1955 | Lipson | 138/44 X |
| 3,229,723 | 1/1966 | Janton | 138/44 |
| 3,468,483 | 9/1969 | Parkinson | 239/460 |
| 3,537,482 | 11/1970 | Rudewick | 138/44 |
| 3,547,353 | 12/1970 | Pecka | 239/460 |
| 3,642,031 | 2/1972 | Wright | 239/24 X |
| 3,647,144 | 3/1972 | Parkinson et al. | 239/456 |

FOREIGN PATENTS OR APPLICATIONS

| | | | |
|---|---|---|---|
| 256,891 | 8/1926 | United Kingdom | 138/44 |
| 442,318 | 2/1936 | United Kingdom | 239/31 |

*Primary Examiner*—Robert S. Ward, Jr.
*Attorney, Agent, or Firm*—Leo Gregory

[57] ABSTRACT

This invention relates to an improvement in a device which reduces the flow of water through a shower head. The invention consists of a unitary cylindrical member being inserted into the delivery end of a water supply line adjacent a shower head connected thereto, the cylindrical member having a restrictive passage therethrough in the direction of the flow of water and the member being retained in position during operation of a shower by water pressure.

1 Claim, 5 Drawing Figures

SHOWER HEAD WATER FLOW REDUCING DEVICE

SUMMARY AND BACKGROUND OF THE INVENTION

The invention herein relates to a device arranged and constructed to reduce the flow of water through a shower head with the intended result that less water will be used for any given shower. With a reduction in the amount of water used, there follows that there will be a corresponding reduction in the amount of energy to heat water and there will be a corresponding reduction in the requirement for materials to treat the water, such as for softening purposes.

The device herein is intended for institutional as well as for home use. It has been found, by way of example, that in school facilities, such as in shower rooms, that the showers may be turned on for considerable periods of time such as for an entire swim period, with only intermittent use. Here the restriction on the flow of water would result in a very substantial reduction of the water used.

The average use of water for a shower for an individual, as in a home, with water pressure on the order of 40–60 psi is about 2.5 gallons a minute. From 6 to 8 gallons are readily saved for each shower taken. It can be appreciated that there would result a very substantial reduction in total water used such as in school showering facilities.

It has been found that a user in a very short time becomes accustomed to a reduced flow of water. There is no regulation by the user of the restriction of the flow of water imposed by the invention herein.

It is an object of the invention herein to provide a device to restrict the flow of water through a shower head, said device not being subject to regulation by a user.

It is a further object of the invention herein to provide a device to restrict the flow of water at a shower head with the device being unitary in construction and requiring no tools for its installation except for the removal of the shower head.

It is more specifically an object of the invention herein to provide an unitary device insertable by hand into the delivery end of a supply line running to a shower head, said device being slip-fit within said supply line and having a restrictive passage therethrough in the direction of the flow of water.

These and other objects and advantages of the invention will be set forth in the following description made in connection with the accompanying drawings in which like reference characters refer to similar parts throughout the several views and in which.

DESCRIPTION OF A PREFERRED EMBODIMENT

Figure 1:
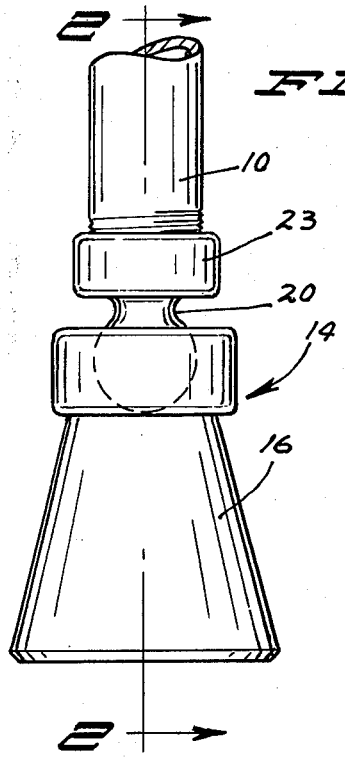
FIG. 1 is a broken view in elevation.

Referring to the drawings, a water supply line 10 is shown running from a water supply source. Said supply line has an externally threaded end portion 12 to which is connected a conventional type of shower head 14.

Said shower head comprises a discharge head portion 16 having a socket 18 therein into which is seated a ball 20 secured by a lock nut 22.

Said ball includes an upper nut portion 23 which is secured to said supply line and extending through said nut and ball portion through to the discharge head 16 is a passage 26. Said passage is of a size to permit the flow of a substantial volume of water.

Inserted into said threaded end portion of said supply line and seated onto the base 28 of the nut portion 23 is the device 30 which comprises the subject matter of the invention herein. Said device comprises a cylindrical body portion 32 and will be formed preferably as an extrusion or as a molding of a suitably plastic material. Said body portion has a small restrictive axial passage or orifice 34 therethrough.

It has been found that a passage of approximately 0.090 inches in diameter under ordinary house pressure of water as on the order of 40–60 psi is sufficient to provide an adequate flow of water for showering purposes.

The size of the passage indicated will provide approximately 1.2 gallons of water per minute at the water pressure above stated. This has been found to represent a saving or reduction in use of 6 to 8 gallons of water for each shower taken.

Figure 5:
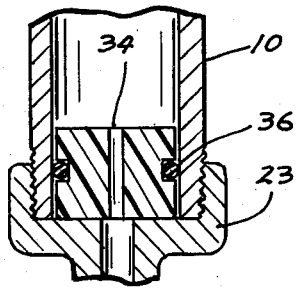
FIG. 5 is a broken view with a portion in section showing a modification.
Figure 4:
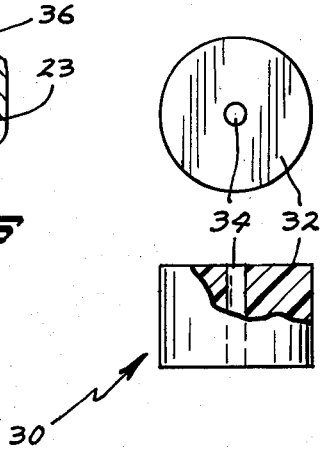
FIG. 4 is a composite view of the device herein showing a top plan view and a partial view in vertical section thereof.

Referring to FIG. 5, a modification is shown in which an O-ring 36 encircles said device 30 for insertion therewith into said supply line as above described. Said O-ring provides an effective seal and provides for good frictional engagement between said device and said supply line.

Figure 2:
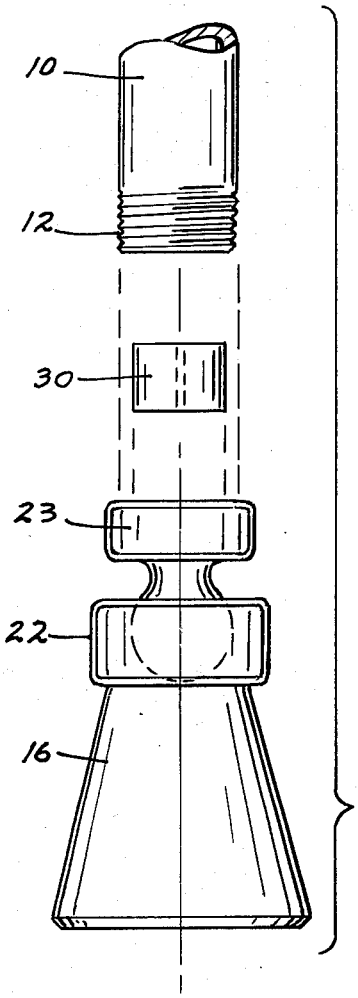
FIG. 2 is an exploded view in elevation taken on line 2—2 of FIG. 1 as indicated.
Figure 3:
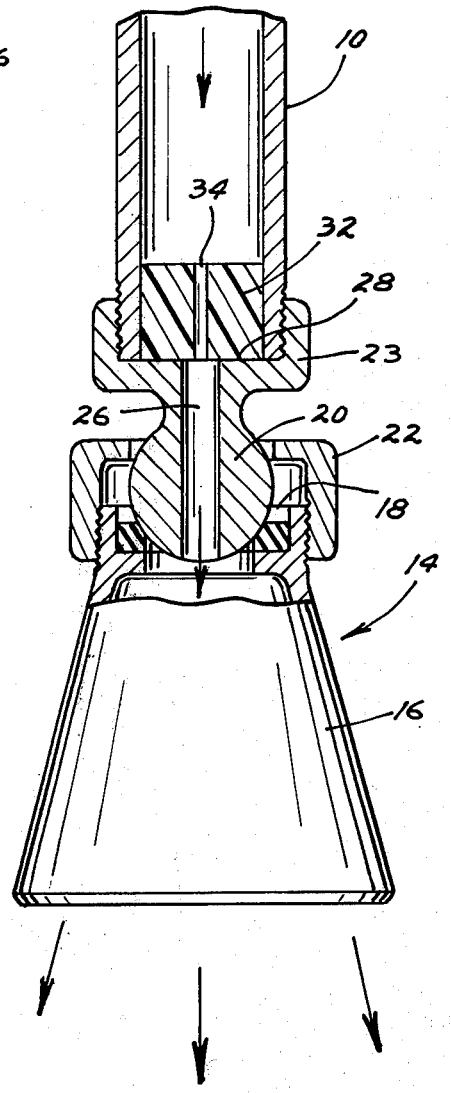
FIG. 3 is a broken view in partial vertical section.

It will be understood however that the structure of the device 30 as shown in FIGS. 2 and 3 is securely seated onto the base 28 of the member 23 by the pressure of water and that there is no noticeable leakage about the device when it is merely slip-fit into said supply line 10. Hence the device is very easily put into operating position.

The device 30 in its installed position is free from manipulation by any one using a shower head having such an installation. The conservation of water indicated herein is an assured saving of or reduction in the use of water and there is no reliance for this saving upon the habit or conduct of the user.

The invention herein has been tested and it has been found that persons using such a shower arrangement readily adapt themselves to a reduced flow of water. The installation of the device is very simply accomplished and it is maintenance free. The essential novelty of the invention herein is present in its simplicity of construction and of its installation.

It will of course be understood that various changes may be made in the form, details, arrangement and proportions of the invention without departing from the scope of applicant's invention which, generally stated, consists in a device capable of carrying out the objects above set forth, such as disclosed and defined in the appended claims. 10

What is claimed is:

1. A shower head water flow reducing apparatus, having in combination, a water supply line, a shower head connected to said water supply line, a member formed as a cylindrical body portion slip-fit into said supply line adjacent to the inlet end of said shower head, a small axial passage through said body portion, whereby water pressure maintains said member in operating position.

* * * * *